US006353426B1

(12) United States Patent
Yamashita

(10) Patent No.: US 6,353,426 B1
(45) Date of Patent: Mar. 5, 2002

(54) LIQUID CRYSTAL DISPLAY CONTROL SYSTEM CONTROLLABLE OF CONNECTION BETWEEN A DRIVER CIRCUIT AND EACH OF COMMON LINES

(75) Inventor: Masayoshi Yamashita, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/427,170

(22) Filed: Oct. 26, 1999

(30) Foreign Application Priority Data

Oct. 27, 1998 (JP) ..... 10-304842

(51) Int. Cl.[7] ..... G09G 3/36
(52) U.S. Cl. ..... 345/100; 345/87; 345/98
(58) Field of Search ..... 345/87, 88, 89, 345/98, 99, 100, 211, 212, 213, 90, 91, 92, 93, 94, 95, 96, 97, 33, 38, 50, 55, 467, 471, 472, 472.1

(56) References Cited

U.S. PATENT DOCUMENTS 5,894,297 A * 4/1999 Mizutome et al. ..... 345/99

FOREIGN PATENT DOCUMENTS

EP 0 657 864 A1 6/1995
EP 0 780 825 A1 6/1997

* cited by examiner

*Primary Examiner*—Xiao Wu
(74) *Attorney, Agent, or Firm*—Scully, Scott, Murphy & Presser

(57) ABSTRACT

In a liquid crystal display control system for performing a display on a liquid crystal panel, a control arrangement is provided for controlling connection between a driver circuit and each of common lines in the liquid crystal panel. The common lines are arranged to form a lattice fashion in cooperation with segment lines in the liquid crystal panel.

10 Claims, 3 Drawing Sheets

LIQUID CRYSTAL DISPLAY CONTROL SYSTEM CONTROLLABLE OF CONNECTION BETWEEN A DRIVER CIRCUIT AND EACH OF COMMON LINES

BACKGROUND OF THE INVENTION

The present invention relates to a liquid crystal display control system which is particularly suitable for controlling a liquid crystal panel of a mobile radio terminal, such as a portable telephone terminal, a PHS (personal handyphone system) or a pager terminal.

In mobile radio terminals, for realizing reduction in size and weight, the size of a display area of a liquid crystal panel is limited and a display font should also be minimized. Thus, positions of dots to be displayed on the liquid crystal panel are calculated at a controller such as a CPU which then supplies them to a driver circuit of the liquid crystal panel as data indicative of the display contents.

Accordingly, depending on the display contents, the controller calculates the display positions even in case of a fixed font upon every occasion of changing the display positions. This causes a problem that the display speed is lowered.

This problem is solved by performing a display of a fixed display unit such as an 8-bit unit. However, if characters each of a font of, for example, 12 dots in a length direction are displayed in a display area of, for example, a multiple of 8 dots in the length direction, a space of 4 dots in the length direction is generated between the displayed characters. That is, one character of 12 dots in the length direction is displayed in a display area of 16 dots in the length direction, with a space of 4 dots in the length direction being generated.

Therefore, the occupying rate of the displayed characters relative to the whole display area of the liquid crystal panel is reduced so that it is not easy for a user to see the displayed contents. Thus, when performing the foregoing fixed unit display, there is raised a problem that although the display speed is not lowered, an easy-to-see display can not be achieved when a font of the display contents is changed.

SUMMARY OF THE INVENTION

It is therefore an object of the present invention to provide a liquid crystal display control system which is capable of preventing lowering of the display speed, while reducing the number of using dots in the length direction according to a font of the display contents so as to enable an easy-to-see display.

Other objects of the present invention will become clear as the description proceeds.

According to an aspect of the present invention, there is provided a liquid crystal display control system for performing a display on a liquid crystal panel having common lines and segment lines which are arranged in a lattice fashion and connected to a driver circuit, the liquid crystal display control system comprising connection control means connected to the driver circuit for controlling connection between the driver circuit and each of the common lines.

According to another aspect of the present invention, there is provided a liquid crystal display control system for receiving data indicative of display contents and scanning common lines each extending in a width direction of a liquid crystal panel and segment lines each extending in a length direction of the liquid crystal panel to turn on and off corresponding dots so as to display the display contents on the liquid crystal panel, the system liquid crystal display control system comprising control means in that, among the predetermined number of dots in the length direction defined by a display unit predetermined relative to the liquid crystal panel, the common lines corresponding to the dots of a designated font or corresponding to the dots of the designated font and a space of at least one line are connected to a driver circuit, while at least one of the common lines corresponding to the remaining dots is not connected to the driver circuit, and that the number of the common lines not connected to the driver circuit is determined corresponding to the designated font.

According to still another aspect of the present invention, there is provided a liquid crystal display control system for scanning, with respect to data indicative of display contents stored in a display memory, common lines each extending in a width direction of a liquid crystal panel and segment lines each extending in a length direction of the liquid crystal panel to turn on and off corresponding dots so as to display the display contents on the liquid crystal panel, the liquid crystal display control system comprising control means in that, among the predetermined number of dots in the length direction defined by a display unit predetermined relative to the liquid crystal panel, the common lines corresponding to a display area of the liquid crystal panel for non-display data included in the data indicative of the display contents and determined by a selected font are not connected to a driver circuit, while the common lines corresponding to a display area of the liquid crystal panel for display data included in the data indicative of the display contents and corresponding to the number of the dots of the font in the length direction are connected to the driver circuit.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Figure 1:
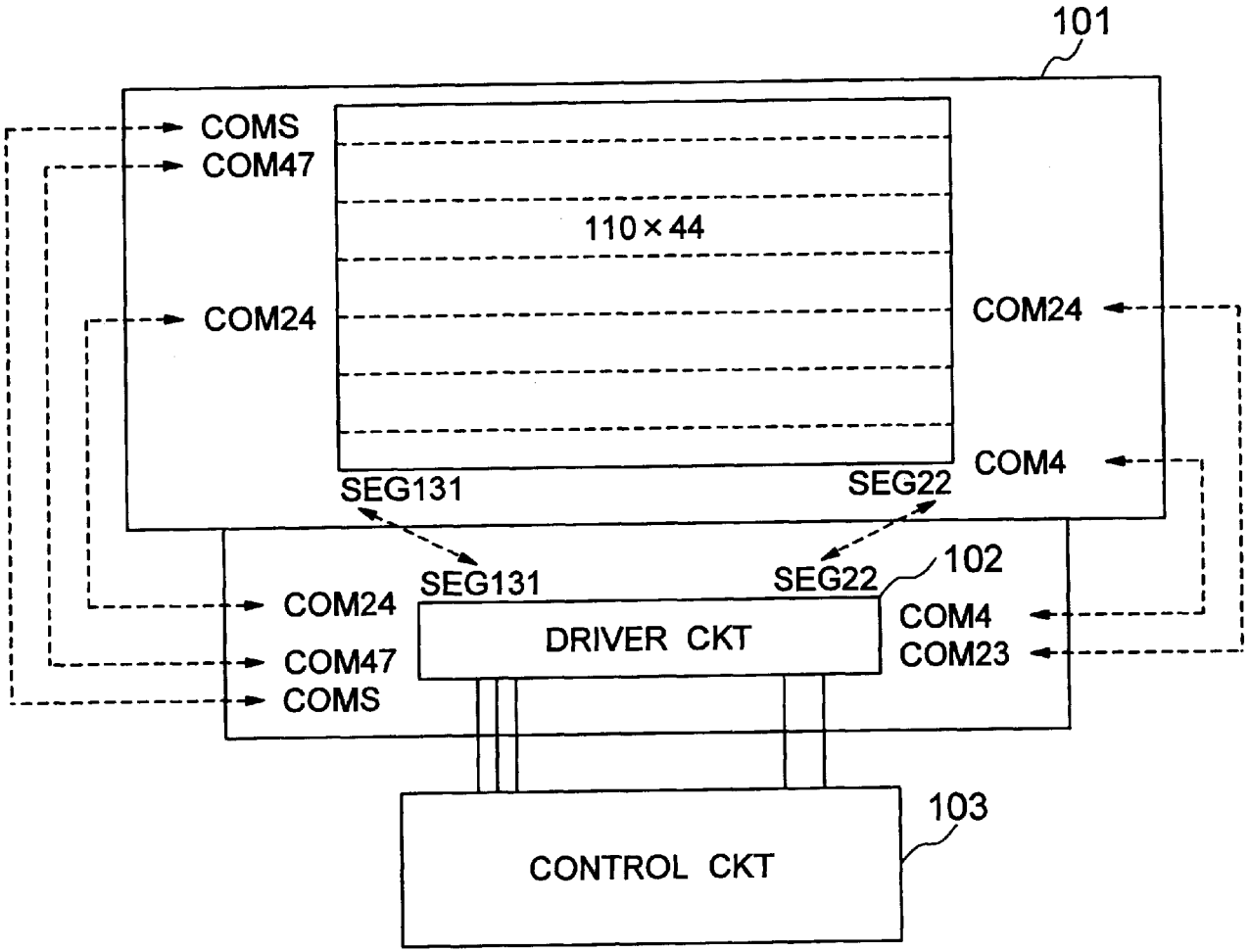
FIG. 1 is a diagram showing a liquid crystal display control section of a portable telephone terminal according to a preferred embodiment of the present invention.

With reference to FIG. 1, description will be made as regards a liquid crystal display control section of a portable telephone terminal according to a preferred embodiment of the present invention. The liquid crystal display control section comprises a liquid crystal panel 101 known in the art, a driver circuit 102 for driving common lines and segment lines on the liquid crystal panel 101 for a display, and a control circuit 103 for transferring data indicative of the display contents to the driver circuit 102.

In the portable telephone terminal, a structure other than that shown in FIG. 1 is known in the art. Specifically, the portable telephone terminal further includes a radio section having an antenna, a receiver for amplifying and demodulating a received signal and a transmitter for modulating and amplifying a transmission signal, a signal processing section, a CPU, a RAM, a ROM, a microphone as a sound input means, a loudspeaker as a sound output means, and an input operating section such as a ten-key and switches. The CPU is connected to the liquid crystal display control section via a bus.

In the liquid crystal panel 101, each of common lines (electrodes) COM4 to COM23, COM24 to COM47, and COMS extends in a line or width direction of the liquid crystal panel 101. Each of segment lines (electrodes) SEG22 to SEG131 extends in a column or length direction thereof. The common lines and the segment lines are arranged in a lattice fashion corresponding to the number of dots in the liquid crystal panel 101 and connected to corresponding control lines of the driver circuit 102, respectively.

The driver circuit 102 receives data indicative of the display contents from the control circuit 103 and scans the common lines and the segment lines to turn on and off corresponding dots so as to display the display contents.

Figures 2A, 2B:
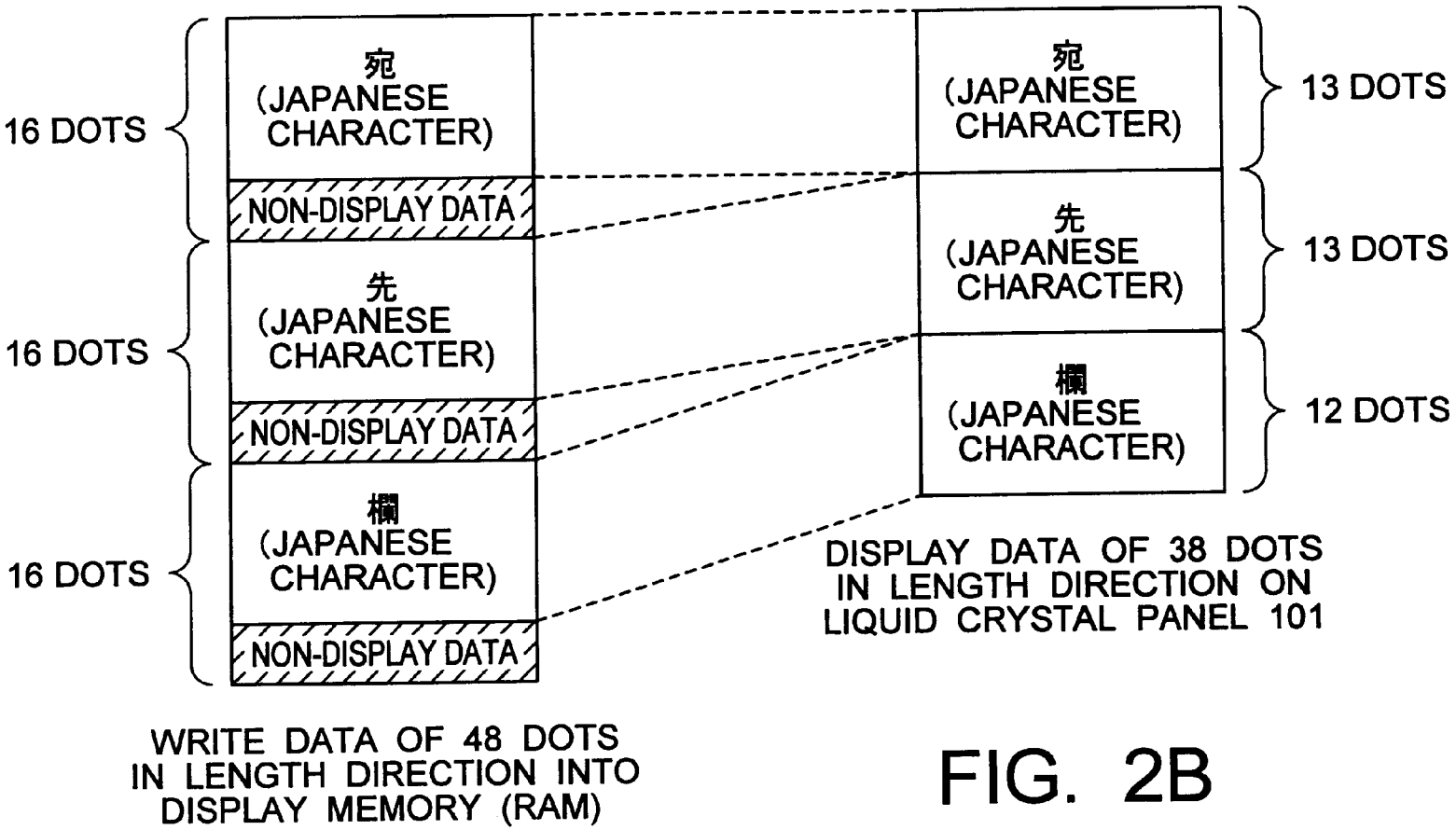
FIGS. 2A & 2B is a diagram for explaining a relationship between data allocation in a display memory (RAM) for storing data indicative of the display contents and data displaying on the liquid crystal panel according to the preferred embodiment of the present invention.

Now, the description will be made as regards an example wherein the display unit is 8 bits, and three Japanese characters each of a font of 12 dots in the length direction are displayed in the length direction. Referring to FIGS. 2A & 2B in addition, the description will be directed to a relationship between data allocation in a display memory (RAM) for storing data indicative of the display contents and data displaying on the liquid crystal panel 101. As shown in FIG. 2A, a control application executed on the CPU of the portable telephone terminal writes data of 48 dots in the length direction (a multiple of 16 dots in the length direction) into the display memory. In this event, with respect to each 16 dots in the length direction, font data (display data) of 12 dots as well as non-display data of 4 dots including no font data are written into the display memory.

According to the conventional technique, the contents of the display memory as shown in FIG. 2A are directly displayed on the liquid crystal panel so that there is provided a space of 4 dots in the length direction below each of the displayed characters.

On the other hand, in this embodiment, the common lines of the liquid crystal panel 101 are connected to the driver circuit 102 in the following manner. With respect to the upper 16 dots, the common lines for 13 dots from the top (12 dots are for font data, and 1 dot is for a line space) are connected to the driver circuit 102, while the common lines for the remaining 3 dots are not connected to the driver circuit 102. With respect to the intermediate 16 dots, the common lines for 13 dots from the top are connected to the driver circuit 102, while the common lines for the remaining 3 dots are not connected to the driver circuit 102. With respect to the lower 16 dots, the common lines for only 12 dots are connected to the driver circuit 102. Thus, the total of 38 dots in the length direction is displayed on the liquid crystal panel 101 as shown in FIG. 2B.

More particularly, the control circuit 103 designates, as a designated line, at least one of the common lines with reference to the number of the common lines and to a font to be used in the display. In this event, the control circuit 103 will be referred to as a designating arrangement. Furthermore, the control circuit 103 disconnects the designated line from the driver circuit 102. In this event, the control circuit 103 will be referred to as a disconnecting arrangement. A combination of the designating arrangement and the disconnecting arrangement is referred to as a connection control arrangement.

The control circuit 103 uses a 16-dot area for sending data indicative of the display contents per character to the driver circuit 102. In this event, since a font is specified in the data (in this example, a font of 12 dots in the length direction is notified from the CPU), the control circuit 103 can identify non-display lines corresponding to the non-display data, from such font information and the display unit information of the 16-dot area.

In other words, the liquid crystal display control system is constituted in that the common lines are divided into a plurality of line groups each of which is determined in accordance with an unit for the display and comprises primary lines corresponding to the font and at least one line as the designated line. Each of the line groups may comprise at least one spacing-line between the designated line and one of the primary lines. In these arrangements, the designated line is disconnected from the driver circuit 103, while the primary lines and the spacing-line are connected to the driver circuit 103.

Figure 3:
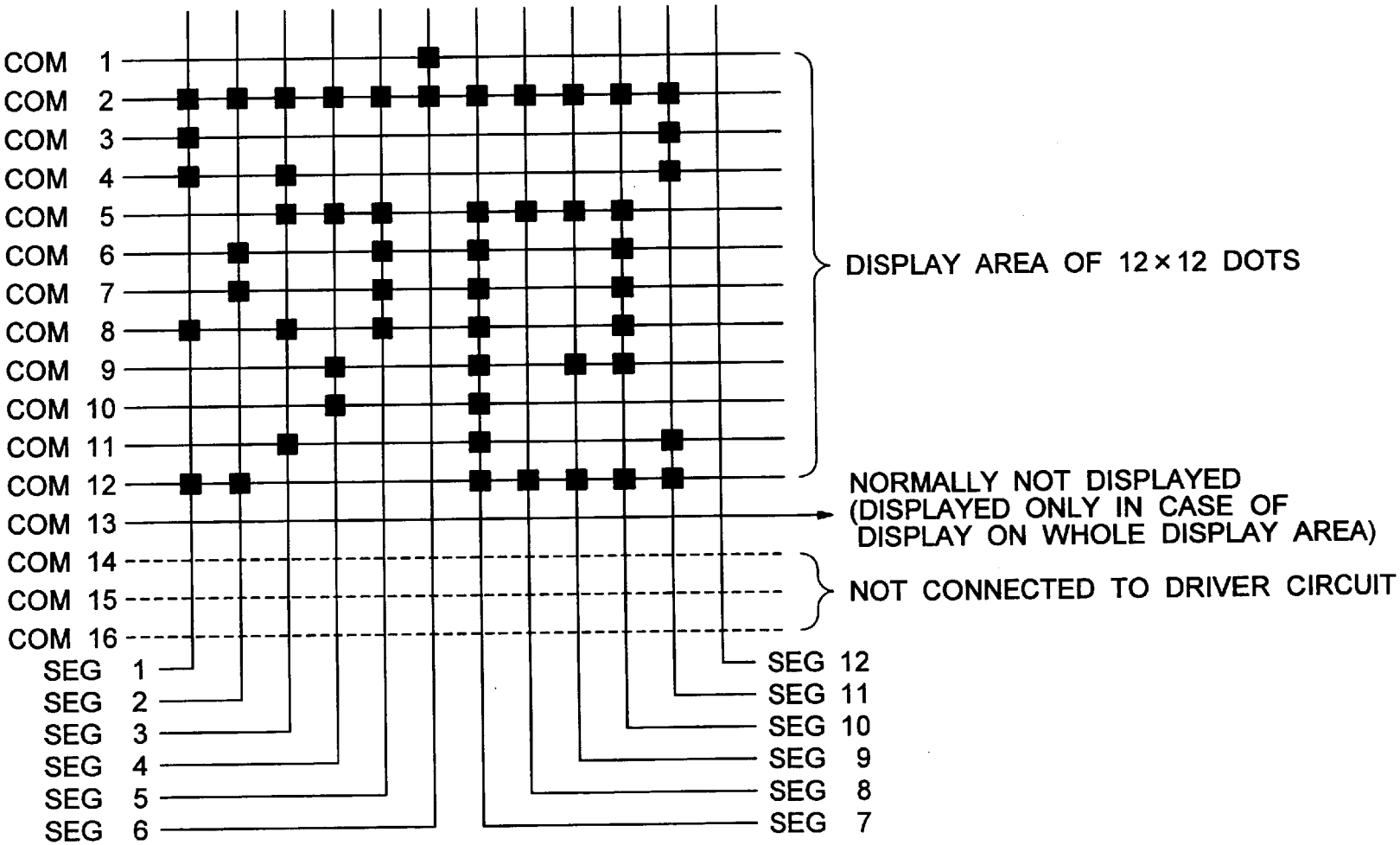
FIG. 3 is a diagram showing an example of a display implemented by a liquid crystal panel of the liquid crystal display control section according to the preferred embodiment of the present invention.

With reference to FIG. 3 in addition, the description will be made as regards a state of a display implemented by the liquid crystal panel 101. The driver circuit 102 displays the data from the control circuit 103 on the liquid crystal panel 101. In this event, however, since the common lines COM13 to COM16 corresponding to the non-display data are not present when displaying one character (in case of displaying only one character in the length direction, COM13 is also not connected to the driver circuit 102 since a line space is not necessary), the character can be displayed larger relative to a display area of the liquid crystal panel 101 as compared with the conventional liquid crystal display.

On the other hand, when performing a display using the whole display area of the liquid crystal panel 101, the driver circuit 102 scans the control lines to drive the liquid crystal panel 101 based on the data transferred from the control circuit 103. In this event, although the non-display data actually exists in the data from the control circuit 103, since there are no corresponding common lines COM14 to COM16 in the liquid crystal panel 101, three characters each of 12 dots in the length direction are displayed on the liquid crystal panel 101 with a space of one line (corresponding to COM13) interposed between the adjacent characters as shown in FIG. 2B.

A selector switch or the like may be used for controlling connection and disconnection between the common lines of the liquid crystal panel 101 and the corresponding control lines of the driver circuit 102.

As described above, according to the foregoing preferred embodiment of the present invention, the common lines of the liquid crystal panel 101 are connected to the corresponding control lines of the driver circuit 102 in a decimated manner so as to be suitable for the number of dots to be displayed, as opposed to the conventional technique wherein the common lines of the liquid crystal panel are connected to the corresponding control lines of the driver circuit in a one-to-one manner. Thus, since the number of dots in the length direction can be reduced corresponding to a font of the display contents, an easy-to-see display can be achieved without lowering the display speed. Further, a line space between the displayed characters in the length direction of the liquid crystal panel 101 can be diminished, a well-balanced display can be realized.

While the present invention has been described in terms of the preferred embodiment, the invention is not to be limited thereto, but can be embodied in various ways without departing from the principle of the invention as defined in the appended claims.

What is claimed is:

1. A liquid crystal display control system for performing a display on a liquid crystal panel having common lines and segment lines which are arranged in a lattice fashion and connected to a driver circuit, said liquid crystal display control system comprising connection control means connected to said driver circuit for controlling connection between said driver circuit and each of said common lines, wherein said connection control means comprises:

designating means for designating, as a designated line, at least one of said common lines with reference to the number of said common lines and to a font to be used in said display; and disconnecting means connected to said designating means and said driver circuit for disconnecting said designated line from said driver circuit.

2. A liquid crystal display control system as claimed in claim 1, wherein said common lines are divided into a plurality of line groups each of which is determined in accordance with an unit for said display and comprises primary lines corresponding to said font and at least one line as said designated line, said primary lines being connected to said driver circuit.

3. A liquid crystal display control system as claimed in claim 1, wherein each of said line groups further comprises at least one spacing-line between said designated line and one of said primary lines, said at least one spacing-line being connected to said driver circuit.

4. A mobile terminal comprising the liquid crystal control system according to claim 1.

5. A liquid crystal display control system for receiving data indicative of display contents and scanning common lines each extending in a width direction of a liquid crystal panel and segment lines each extending in a length direction of said liquid crystal panel to turn on and off corresponding dots so as to display the display contents on said liquid crystal panel, said system liquid crystal display control system comprising control means in that, among the predetermined number of dots in the length direction defined by a display unit predetermined relative to said liquid crystal panel, said common lines corresponding to the dots of a designated font or corresponding to the dots of the designated font and a space of at least one line are connected to a driver circuit, while at least one of said common lines corresponding to the remaining dots is not connected to said driver circuit, and that the number of said common lines not connected to said driver circuit is determined corresponding to said designated font.

6. A mobile terminal comprising the liquid crystal display control system according to claim 5.

7. A liquid crystal display control system for scanning, with respect to data indicative of display contents stored in a display memory, common lines each extending in a width direction of a liquid crystal panel and segment lines each extending in a length direction of said liquid crystal panel to turn on and off corresponding dots so as to display the display contents on said liquid crystal panel, said liquid crystal display control system comprising control means in that, among the predetermined number of dots in the length direction defined by a display unit predetermined relative to said liquid crystal panel, said common lines corresponding to a display area of said liquid crystal panel for non-display data included in said data indicative of the display contents and determined by a selected font are not connected to a driver circuit, while said common lines corresponding to a display area of said liquid crystal panel for display data included in said data indicative of the display contents and corresponding to the number of the dots of said font in the length direction are connected to said driver circuit.

8. A liquid crystal display control system as claimed in claim 7, wherein in case of a display in the whole display area of said liquid crystal panel, the common line corresponding to the dots of a line adjacent to an end of said display data is connected to said driver circuit for a display as a line space.

9. A liquid crystal display control system as claimed in claim 8, wherein next display data adjacent to said display data is displayed from a line adjacent to said line space.

10. A mobile terminal comprising the liquid crystal display control system according to claim 7.

* * * * *